US005645477A

United States Patent [19]

Satoh et al.

[11] Patent Number: 5,645,477

[45] Date of Patent: Jul. 8, 1997

[54] CHANGE RETURNING DEVICE OF COIN MECHANISM

[75] Inventors: Naoto Satoh; Kazumi Ohsato, both of Mashashi, Japan

[73] Assignee: Sanden Corporation, Isesaki, Japan

[21] Appl. No.: 649,109

[22] Filed: May 17, 1996

[30] Foreign Application Priority Data

May 19, 1995 [JP] Japan ..... 7-121849

[51] Int. Cl.[6] ..... G07D 1/02

[52] U.S. Cl. ..... 453/40; 453/41

[58] Field of Search ..... 453/18, 20, 21, 453/39, 40, 41, 42, 43

[56] References Cited

U.S. PATENT DOCUMENTS

| | | | |
|---|---|---|---|
| 2,954,037 | 9/1960 | Williams et al. | 453/42 X |
| 3,401,704 | 9/1968 | Jullien-Davin | 453/41 X |
| 4,080,973 | 3/1978 | Kobayashi | 435/41 |
| 4,284,093 | 8/1981 | Hayashi . | |
| 4,313,450 | 2/1982 | Kirisawa . | |
| 4,606,362 | 8/1986 | Kobayashi et al. . | |
| 5,011,456 | 4/1991 | Kobayashi et al. . | |
| 5,052,538 | 10/1991 | Satoh | 453/17 X |

FOREIGN PATENT DOCUMENTS

| | | | |
|---|---|---|---|
| 3641346 | 6/1988 | Germany | 453/40 |
| 4207744 | 9/1993 | Germany | 453/41 |
| 193285 | 7/1990 | Japan | 453/41 |
| 311293 | 11/1992 | Japan | 453/41 |
| 120508 | 5/1993 | Japan | 453/41 |

*Primary Examiner*—Karen B. Merritt
*Assistant Examiner*—Scott L. Lowe
*Attorney, Agent, or Firm*—Banner & Witcoff, Ltd.

[57] ABSTRACT

This invention is directed to a change returning device employed in a coin mechanism of a vending machine. The change returning device is associated with a lower end of a change stacking tube, and includes a ring-shaped member capable of containing the lowest coin stacked within the tube. A block member is connected to a lower end surface of one peripheral portion the ring-shaped member. The block member is disposed on a sliding plate and engageable therewith. The sliding plate is slidably reciprocatingly disposed on a stationary member. A first sloped surface is formed at a part of an upper end surface of the stationary member and a second sloped surface is formed at a part of an upper end surface of the block member. An inclined vertical groove extends from a lower edge of the first sloped surface. The lower edge of the second sloped surface of the block member projects beyond the upper edge of the first sloped surface of the stationary member when the sliding plate reaches at a first furthermost point together with the block member during reciprocating motion of the sliding plate. The second sloped surface of the block member is generally aligned with the first sloped surface of the stationary member when the sliding plate reaches a second furthermost point together with the block member during reciprocating motion of the sliding plate.

7 Claims, 5 Drawing Sheets

CHANGE RETURNING DEVICE OF COIN MECHANISM

BACKGROUND OF THE INVENTION

1. Technical Field of the Invention

This invention generally relates to a coin mechanism for use in a vending machine, and more particularly, to a change returning device employed in the coin mechanism.

2. Description of the Prior Art

Coin mechanisms having a change returning device are well known in the art. Such a conventional coin mechanism is schematically illustrated in FIG. 1.

With reference to FIG. 1, one conventional coin mechanism 10' includes housing 11 which contains a deposited coin-like object Judging device 13, a plurality of, for example, four coin stacking cylindrical tubes 14 and an extra coin stacking cylindrical tube 15 therewithin. The judging device 13 is linked to a coin conducting port 12 which is provided at a top end portion of the housing 11. The coin stacking tubes 14 are located at a position below the judging device 13, and are linked to the judging device 13 through a sorting device (not shown). A plurality of, for example, four kinds of coins 30*a*, 30*b*, 30*c* and 30*d* are stacked within the four coin stacking tubes 14, respectively. The coin stacking tubes 14 are adjacent to each other, and extend along the longitudinal axis of the housing 11. The extra coin stacking tube 15 is adjacent to one coin stacking tube 14 which is located at an outermost side, and also extends along the longitudinal axis of the housing 11. One kind of coins, for example, coins 30*a* are preliminarily and supplementarily stacked within the extra tube 15. Furthermore, an inner diameter of each of the cylindrical tubes 14 and 15 is designed to be slightly greater than a diameter of the corresponding coins 30*a*, 30*b*, 30*c* and 30*d*.

Each of the coin stacking tubes 14 is provided with a change returning device (not shown) at a position immediately therebelow. The extra coin stacking tube 15 is also provided with a change returning device 16 (hereafter, returning device 16) which is described in detail below with reference to FIGS. 2 and 3.

With reference to FIGS. 2 and 3, the returning device 16 is located at a position immediately below a lower end of extra tube 15. For purposes of explanation only, in FIGS. 2 and 3, the left side will be referred to as the front or forward side and the right side will be referred to as the rear or rearward side. The returning device 16 includes a ring-shaped coin ejector 161 and a coin catching plate member 162 which is located at a position below the coin ejector 161. The coin catching plate member 162 comprises a sloped surface 162*a* and a vertical groove 162*b* that is continuous with a lower edge of the sloped surface 162*a*. The sloped surface 162*a* is inclined from the rear to the front. The degree or amount of angular incline of the sloped surface 162*a* is designed such that a coin 30*a* can smoothly slide along the sloped surface 162*a*. A bottom surface 162*c* of the vertical groove 62*b* declines (from the right to the left in FIG. 1), and an inner width of the groove 162*b* is designed to be slightly greater than the thickness of the coin 30*a*. Furthermore, a part of the coin catching plate member 162 forms a receiving portion 162*d* which is capable of receiving a front peripheral region of the ring-shaped coin ejector 161 and a part of an outer peripheral region of the lowest coin 30*a* stacked within the extra tube 15. A projection 161*a* is formed at an inner lower peripheral surface of a rear region of the ring-shaped coin ejector 161 diametrically opposite to the receiving portion 162*d* of the coin catching plate member 162. A projecting end of the projection 161*a* is terminated such that it does not project beyond a center point of the ring-shaped coin ejector 161. Furthermore, an inner diameter of the coin ejector 161 is designed to be slightly greater than the diameter of the coin 30*a*.

The coin ejector 161 is operatively connected to a driving device (not shown), and reciprocatingly moves forwardly and rearwardly (to the left and the right in FIGS. 2 and 3) by virtue of operation of the driving device. That is, in FIG. 1, the coin ejector 161 reciprocatingly moves along a line perpendicular to a drawing sheet. FIG. 2 illustrates one situation where the coin ejector 161 is positioned at the forwardmost point of the reciprocating movement thereof. In this situation, the coin ejector 161 is located at a position just below a lower end of extra tube 15, so that a center point of the ring-shaped coin ejector 161 is essentially aligned with the longitudinal axis of the extra tube 15. Therefore, the lowest coin 30*a* stacked within the extra tube 15 is contained within the ring-shaped coin ejector 161, and is stably received by the receiving portion 162*d* of the coin catching plate member 162 and the projection 161*a* of the ring-shaped coin ejector 161.

FIG. 3 illustrates the other situation where the coin ejector 161 is positioned at the rearmost point of the reciprocating movement thereof. In this situation, the coin ejector 161 is located at a position where the center point of the ring-shaped coin ejector 161 is rearwardly offset from the longitudinal axis of the extra tube 15 by a maximum distance. However, the front peripheral region of the ring-shaped coin ejector 161 is still received on the receiving portion 162*d* of the coin catching plate member 162 and a front peripheral end of the ring-shaped coin ejector 161 is forwardly offset from the longitudinal axis of the extra tube 15 by a slight amount. Therefore, the second lowest coin 30*a* stacked within the extra tube 15 is received by the projection 161*a* of the ring-shaped coin ejector 161.

In a stroke where the coin ejector 161 moves from the forwardmost point as depicted in FIG. 2 to the rearmost point as depicted in FIG. 3, the coin 30*a* contained within the ring-shaped coin ejector 161 falls therefrom just after a time when an inner surface of the front peripheral region of the ring-shaped coin ejector 161 leaves from the receiving portion 162*d* of the coin catching plate member 162.

In operation, a coin-like object (not shown) deposited through a coin slot (not shown) of a vending machine is conducted into the judging device 13 via the coin conducting port 12, and is thereby Judged whether it is a real coin and what kind of coin it is. The coin-like object judged as one of the kind of real coins is sortingly distributed to the corresponding coin stacking tube 14 by the sorting device (not shown) in response to demand.

The coins stacked within each of the stacking tubes 14 are temporarily stored there, and are ejected therefrom one by one beginning with the lowest stacked coin by virtue of operation of the change returning device (not shown) in response to demand. The coin ejected from the stacking tubes 14 falls to a change receiving window (not shown) through a funnel-shaped duct member (not shown).

When the number of the coins 30*a* stacked within the corresponding tube 14 decreases to a first predetermined value, an operation of ejecting the coins 30*a* from the corresponding tube 14 is terminated, and simultaneously, an operation of ejecting the coins 30*a* from the extra tube 15 is initiated. During the operation of ejecting the coins 30*a* from the extra tube 15, the coins 30*a* are distributed from the judging device 13 to the corresponding tubes 14, and therefore, the number of the coins 30*a* stacked within the corresponding tube 14 increases from the first predetermined value. When the number of the coins 30*a* stacked within the corresponding tube 14 increases to a second predetermined value which is significantly larger than the first predetermined value, the operation of ejecting the coins 30*a* from the extra tube 15 is terminated, and simultaneously, the operation of ejecting the coins 30*a* from the tube 14 is reinitiated. Thus, the operation of ejecting the coins 30*a* from the corresponding tubes 14 and the extra tube 15 is selectively carried out in response to the number of the coins 30*a* stacked within the corresponding tubes 14.

The operation of ejecting the coins 30*a* from the extra tube 15 is described with reference to FIGS. 2 and 3. As described above, in the stroke where the coin ejector 161 moves from the forwardmost point as depicted in FIG. 2 to the rearmost point as depicted in FIG. 3, the coin 30*a* contained within the ring-shaped coin ejector 161 falls therefrom Just after the time when the inner surface of the front peripheral region of the ring-shaped coin ejector 161 leaves from the receiving portion 162*d* of the coin catching plate member 162.

The coin 30*a* falling from the coin ejector 161 is caught by the sloped surface 162*a* of the coin catching plate member 162, and slides along the sloped surface 162*a* with either the head or tail surface of the coin 30*a* in contact with an upper surface of the sloped surface 162*a* as illustrated in FIG. 3. The coin 30*a* sliding along the sloped surface 162*a* is received within the vertical groove 162*b* by pivoting about a lower peripheral portion thereof in one direction (in the counter clockwise direction in FIG. 3). Once the coin 30*a* is received within the vertical groove 162*b*, the coin 30*a* rolls along the inclined bottom surface 162*c* of the groove 162*b* as illustrated in FIG. 1. Finally, the coin 30*a* rolling along the inclined bottom surface 162*c* of the groove 162*b* leaves coin mechanism 10' from a lower end of the groove 162*b*, and falls to the change receiving window (not shown) through the funnel-shaped duct member (not shown).

In general, it is required to smoothly conduct the coin 30*a* sliding along the sloped surface 162*a* into the vertical groove 162*b* in order to avoid a jam of the coin 30*a* at the sloped surface 162*a* and/or the vertical groove 162*b*. One solution to avoiding this jam or blockage is to increase the amount of angular incline of the sloped surface 162*a*, so that the coin 30*a* sliding along the sloped surface 162*a* is smoothly conducted into the vertical groove 162*b*.

However, in a limited space, as the inclined angular amount of the sloped surface 162*a* is increased, a longitudinal length of the extra tube 15 is decreased. As a result, the number of coins 30*a* preliminarily and supplementarily stacked within the extra tube 15 may not total the preferred value which prevents the vending machine from frequently running out of coins for returning change. Thus, the vending machine may run out of coins more frequently and may not be able to effectively operate.

SUMMARY OF THE INVENTION

Accordingly, it is an object of the present invention to provide a coin mechanism which can effectively avoid a jam of coins within a change returning path, without decreasing the longitudinal length of a coin stacking extra tube.

According to the present invention, a coin mechanism includes at least one tube within which the change coins are layeredly stacked, and a change returning device. The change returning device includes a ring-shaped member which is disposed at a position adjacent to a lower end of the tube and is capable of containing the lowest coin stacked within the tube. A stationary member includes a first sloped portion which comprises an upper edge and a lower edge, and a flat portion which extends from the upper edge of the first sloped portion.

A sliding plate is slidably disposed on the flat portion of the stationary member. A block member is slidably disposed on the sliding plate. The block member includes a second sloped portion which comprises an upper edge and a lower edge, and a flat portion which extends from the upper edge of the second sloped portion and is fixedly connected to a lower end surface of one peripheral portion of the ring-shaped member. A driving device is operatively connected to the sliding plate so as to slidably reciprocate the sliding plate on the flat portion of the stationary member between a first furthermost point and a second furthermost point which is in a direction opposite to said first point, the sliding plate reciprocates in a direction generally perpendicular to both the lower edge of the second sloped portion and the upper edge of the first sloped portion.

A receiving element receives one peripheral region of the ring-shaped member opposite to the flat portion of the block member. An engaging device engages the sliding plate with the block member in response to demand. An inclined vertical groove is linked from the lower edge of the first sloped portion.

In operation of the coin mechanism, the lower edge of the second sloped portion of the block member projects beyond the upper edge of the first sloped portion of the stationary member when the sliding plate reaches the first furthermost point together with the block member during a reciprocating motion of the sliding plate. The second sloped portion of the block member is generally aligned with the first sloped portion of the stationary member when the sliding plate reaches the second furthermost point together with the block member during the reciprocating motion of the sliding plate.

DETAILED DESCRIPTION OF THE PREFERRED EMBODIMENT

Figure 1:
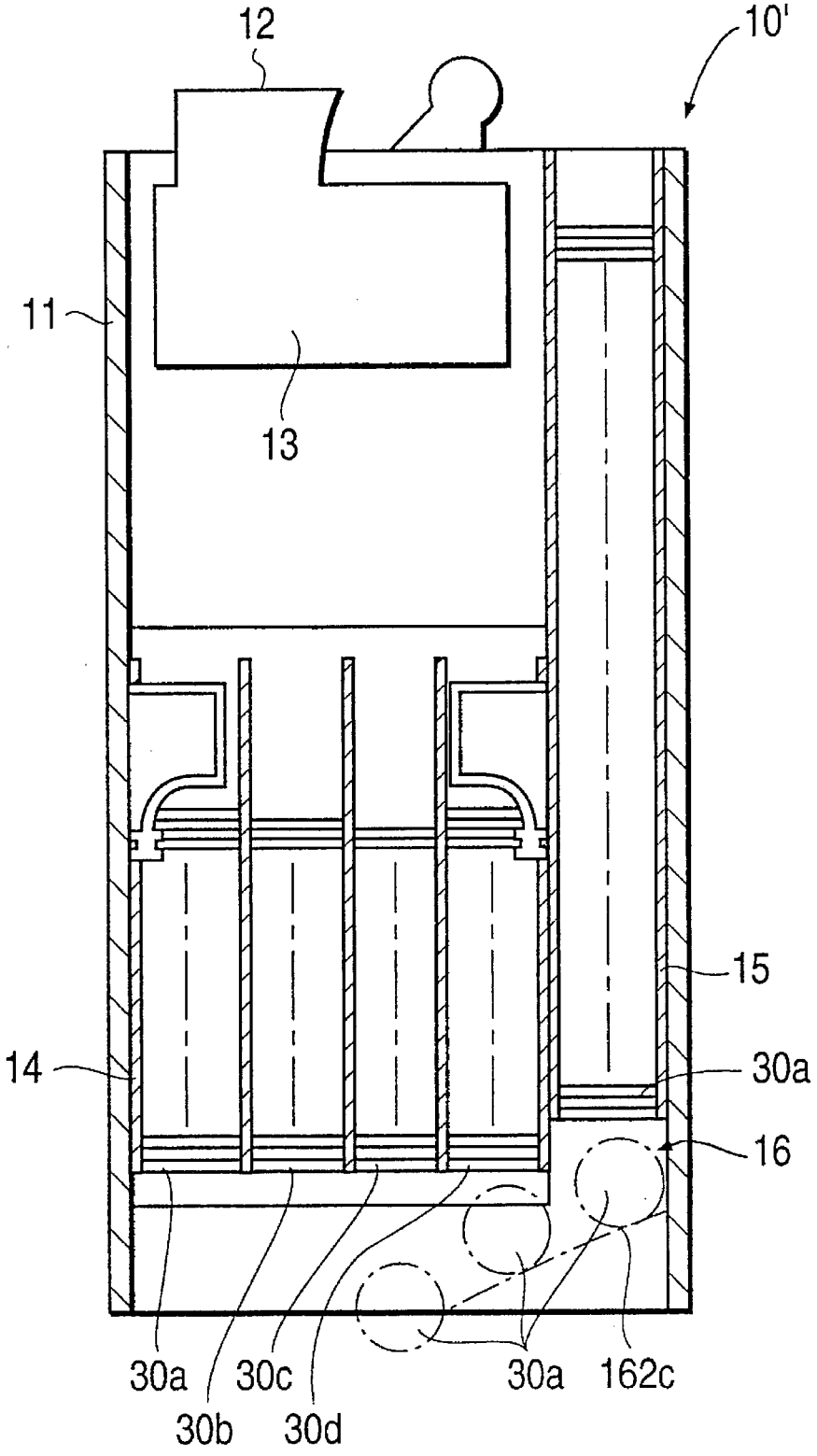
FIG. 1 PRIOR ART
FIG. 1 is a schematic longitudinal sectional view of a coin mechanism in accordance with one prior art embodiment.
Figure 2:
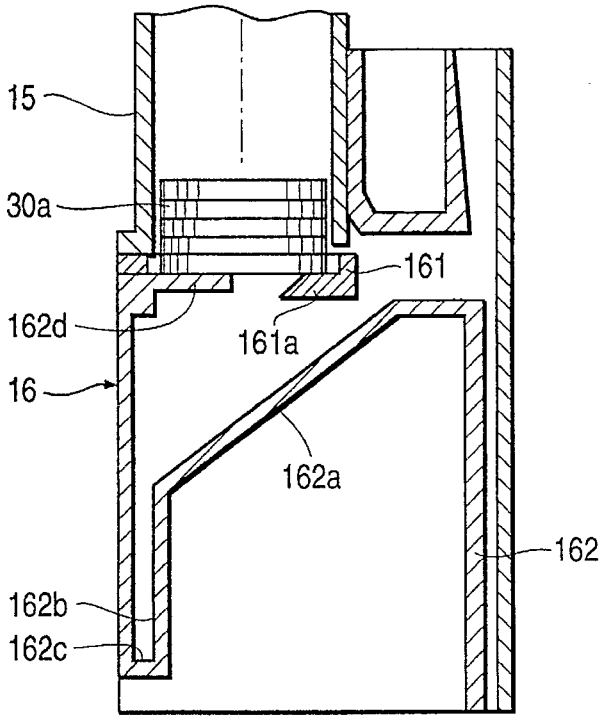
FIG. 2 PRIOR ART
FIG. 2 is an enlarged partial longitudinal sectional view of a relevant part of the coin mechanism shown in FIG. 1. In the drawing, a situation where a coin ejector of a change returning device of the coin mechanism of FIG. 1 is positioned at a forwardmost point of the reciprocating movement thereof is illustrated.
Figure 3:
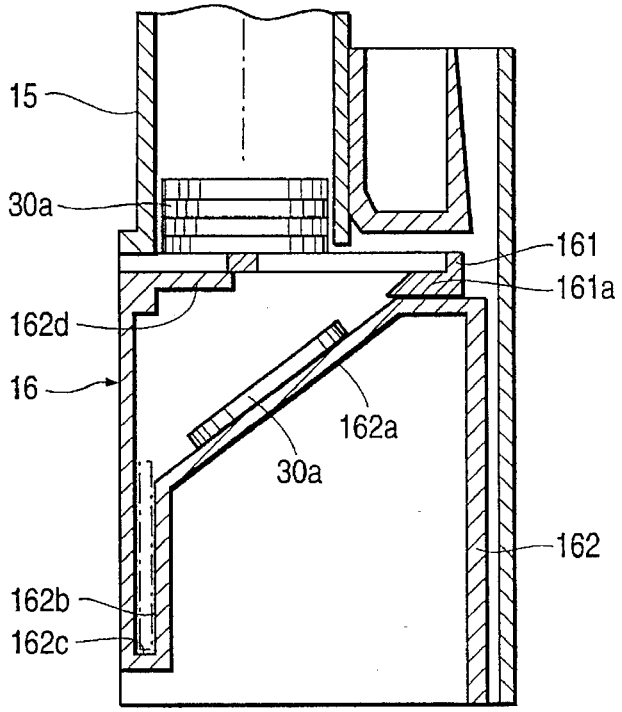
FIG. 3 PRIOR ART
FIG. 3 is a view similar to FIG. 2. In the drawing, a situation where the coin ejector of the change returning device of the coin mechanism of FIG. 1 is positioned at a rearmost point of the reciprocating movement thereof is illustrated.

FIGS. 4–8 illustrate a change returning device employed in a coin mechanism in accordance with one embodiment of the present invention. For purposes of explanation only, in FIGS. 5–8, the left side will be referred to as the front or forward side and the right side will be referred to as the rear or rearward side. The overall construction of the coin mechanism in accordance with the present invention is substantially similar to that shown in FIG. 1 such that a detailed explanation thereof is omitted. Moreover, in FIGS. 4–8, the same reference numerals are used to denote the corresponding elements shown in FIGS. 1–3 and a detailed explanation thereof is also omitted.

As illustrated in FIGS. 5–8, a change returning device 20 (hereafter, returning device 20) is associated with a coin stacking extra tube 15 at a position immediately below a lower end of the extra tube 15. An overall construction of the returning device 20 is described in detail below with reference to FIG. 4 in addition to FIGS. 5–8.

With reference to FIGS. 4–8, the returning device 20 comprises a ring-shaped coin ejector 21 and a coin catching plate member 22 which is located at a position below the coin ejector 21. The coin catching plate member 22 comprises a flat bench 221, a sloped surface 222 and a vertical groove 223. An upper edge 222*a* of the sloped surface 222 is linked to a front end of the flat bench 221, and is inclined from the rear to the front. The vertical groove 223 is linked from a lower edge 222*b* of the sloped surface 222. The amount or degree of angular incline of the sloped surface 222 is designed such that the coin 30*a* can smoothly slide therealong. A bottom surface 223*a* of the vertical groove 223 declines (from the right to the left in FIG. 4), and an inner width of the groove 223 is designed to be slightly greater than the thickness of the coin 30*a*. Furthermore, a part of the coin catching plate member 22 forms a receiving portion 224 by which a front region of the lowest coin 30*a* stacked within the extra tube 15 and a rectangular-shaped projection 211 formed at an outer peripheral surface of a front region of the ring-shaped coin ejector 21 are slidably received.

A block member 23 is disposed at a position Just below the ring-shaped coin ejector 21 and a rear end region thereof is fixedly connected to a rear region of the ring-shaped coin ejector 21. In this embodiment, the block member 23 and the ring-shaped coin ejector 21 are integrally formed with each other. A rear region of a top end surface 231 of the block member 23 adjacent to the rear region of the ring-shaped coin ejector 21 is flat and smooth, so that a flat portion 231*a* is formed at the rear region of the top end surface 231 of the block member 23. The flat portion 231*a* is flush with a lower end surface of the ring-shaped coin ejector 21. A front end of the flat portion 231*a* is terminated such that it does not project beyond a center point of the ring-shaped coin ejector 21. Furthermore, an inner diameter of the ring-shaped coin ejector 21 is designed to be slightly greater than the diameter of the coin 30*a*.

A front region of the top end surface 231 is sloped from the rear to the front, so that a sloped surface 231*b* having an upper edge 231*c* and a lower edge 231*d* is formed at the front region of the top end surface 231 of the block member 23. The upper edge 231*c* of the sloped surface 231*b* is linked to a front end of the flat portion 231*a*. The degree of angular incline of the sloped surface 231*b* is designed to be about equal to the angular incline of the sloped surface 222 of the coin catching plate member 22. A rectangular parallelepiped projection 233 is formed at a rear upper region of the block member 23.

A sliding plate member 24 is slidably disposed on the flat bench 221 of the coin catching plate member 22. A vertical projection 241 having a shoulder section 241*a* is formed at a rear end portion of the sliding plate member 24. The sliding plate member 24 includes a cutout portion 242, which extends along the longitudinal axis of the sliding plate member 24 from a front end of the sliding plate member 24 to the vertical projection 241. A pair of vertical walls 243 generally rectangular in shape project vertically upward from an upper end surface of the sliding plate member 24.

The pair of vertical walls 243 are spaced from each other while the cutout portion 242 intervenes therebetween. A semicircular cutout portion 243*a* is formed at a flat top end surface of each of the vertical walls 243 so as to suitably receive the ends of a later-mentioned cylindrical rod 27. A flat indent 244 is formed at a rear end portion of the upper end surface of the sliding plate member 24. The cutout portion 242 longitudinally extends through the flat indent 244. A rear of the indent 244 is terminated by the vertical projection 241, and a front of the indent 244 is terminated by a projection 245 having a triangular cross section. A beveled portion 246 is formed at the front end of the sliding plate member 24 and has an angular incline which is about equal to the angular incline of the sloped surface 231*b* of the block member 23.

The sliding plate member 24 is operatively connected to a driving device 29, for example, a motor, and reciprocatingly moves forwardly and rearwardly (to the left and the right in FIGS. 5–8) by virtue of operation of the driving device. That is, in FIG. 4, the sliding plate member 24 reciprocatingly moves along a line extending longitudinally through the axis of flat bench 221. A detailed explanation of driving device 29 and the operation of conventional coin mechanisms is described in U.S. Pat. No. 5,052,538 also assigned to Sanden Corporation, and the entire contents of which are hereby incorporated by reference.

The block member 23 is slidably disposed on the sliding plate member 24 while it is fittingly sandwiched between the vertical walls 243. When the block member 23 is disposed on the sliding plate member 24, the rectangular parallelepiped projection 233 is fittingly disposed on the shoulder section 241*a* of the vertical projection 241, and the sloped surface 231*b* of the block member 23 is generally aligned with the beveled portion 246 of the sliding plate member 24. A circular hole 221*a* is centrally formed through a front end portion of the flat bench 221 of the coin catching plate member 22. Therefore, when the sliding plate member 24 is slidably disposed on the flat bench 221 of the coin catching plate member 22, the circular hole 221*a* communicates with a hollow space of the cut-out portion 242 of the sliding plate member 24.

Figure 4:
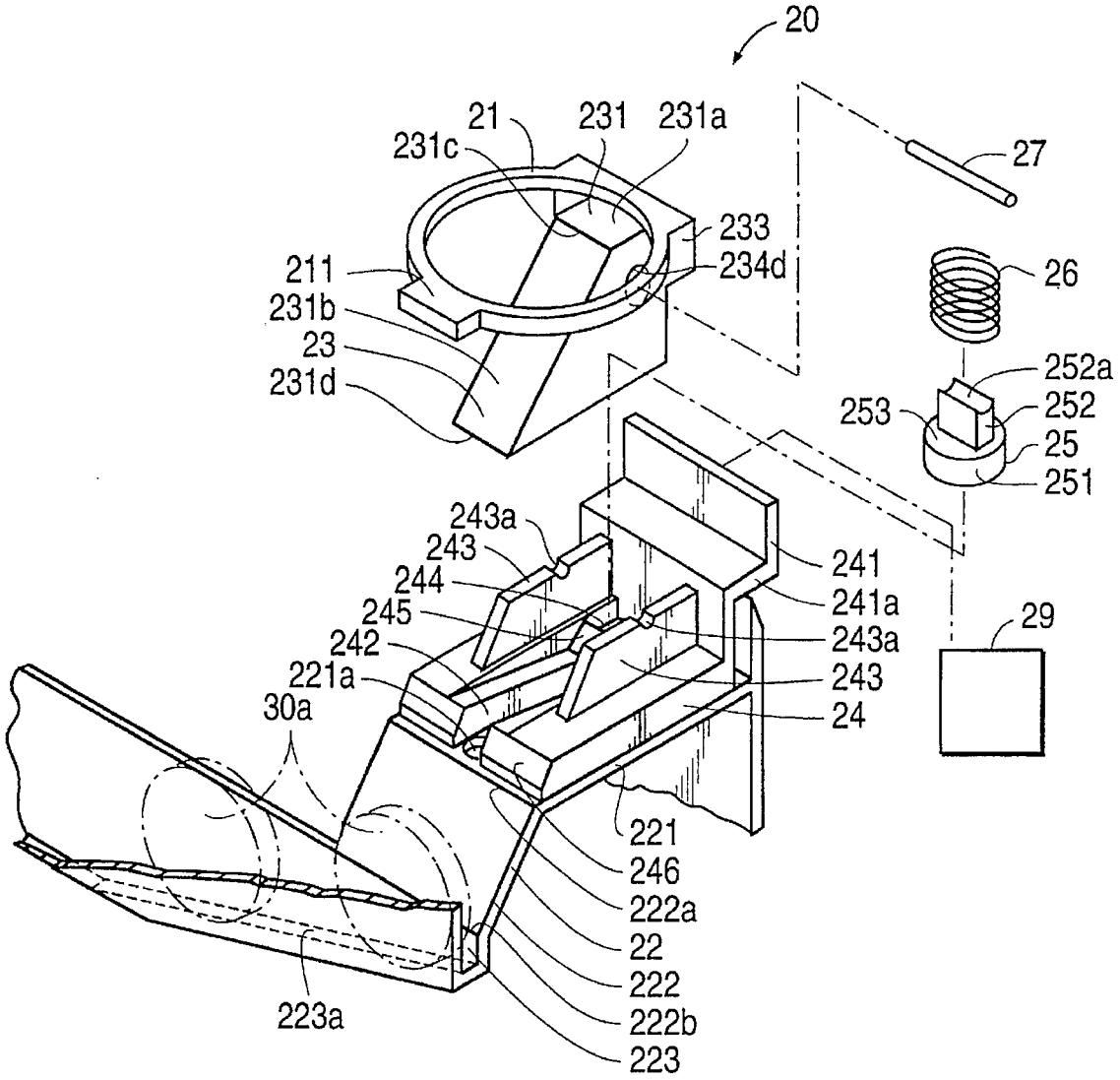
FIG. 4 is an enlarged exploded view of a change returning device of a coin mechanism in accordance with one embodiment of the present invention.

As illustrated in FIGS. 5–8, a vertical hole 234 is formed at a rear end portion of a bottom end surface of the block member 23. The vertical hole 234 includes a lower cylindrical region 234*a* and an upper rectangular parallelpiped region 234*b* which extends from a top end of the cylindrical region 234*a*. A ridge 234*c* is formed at a position which is a boundary between the cylindrical region 234*a* and the rectangular parallelpiped region 234*b*. As illustrated in FIG. 4, a pair of holes 234*d* having an oval cross section laterally extend from an upper portion of the rectangular parallelepiped region 234*b* of the hole 234 in the opposite directions, and are open at the opposite side surfaces of the block member 23, respectively.

A pin element 25 having a lower cylindrical section 251 and an upper rectangular parallelepiped section 252 which extends from a top end surface of the cylindrical section 251 is fitably and slidably disposed within the vertical hole 234. A shoulder 253 is formed at a position which is a boundary between the cylindrical section 251 and the rectangular parallelpiped section 252. A longitudinally extending semicircular groove 252*a* is formed at the top end surface of the rectangular parallelpiped region 252. A coil spring 26 is disposed about the rectangular parallelpiped section 251 of the pin element 25. When the pin element 25 is disposed within the vertical hole 234, the coil spring 26 is resiliently sandwiched by the ridge 234*c* of the vertical hole 234 and the shoulder 253 of the pin element 25. Accordingly, the pin element 25 is continually urged downwardly by virtue of the restoring force of the coil spring 26. A cylindrical rod 27 passes through the pair of holes 234*d*, and a central portion of the cylindrical rod 27 is fixedly connected to a top end surface of the rectangular parallelpiped section 252 of the pin element 25 by means of forcibly inserting the cylindrical rod 27 into the semicircular groove 252*a*. Both ends of the cylindrical rod 27 project from the opposite side surfaces of the block member 23, respectively. A radius of the cylindrical rod 27 is designed to be slightly greater than a radius of the semicircular groove 252*a* of the rectangular parallelpiped region 252 of the pin element 25, but to be slightly smaller than a radius of the semicircular cutout portion 243*a* of the vertical walls 243.

A solenoid 28 having a plunger 281 is disposed within a hollow space defined by the coin catching plate member 22 at a position below the flat bench 221. The plunger 281 is vertically pulled in and is vertically projected out by means of energizing and deenergizing the solenoid 28, respectively. When the solenoid 28 is deenergized, the plunger 281 is maintained in a vertically projected out position, so that a top end of the plunger 281 passes through the circular hole 221*a* and the cutout portion 242 of the sliding plate member 24. On the other hand, when the solenoid 28 is energized, plunger 281 is maintained in a vertically pulled in position, so that the top end of the plunger 281 is located within the circular hole 221*a*.

Operation of the above constructed change returning device 20 is described in detail below with reference to FIGS. 5–8.

Figure 5:
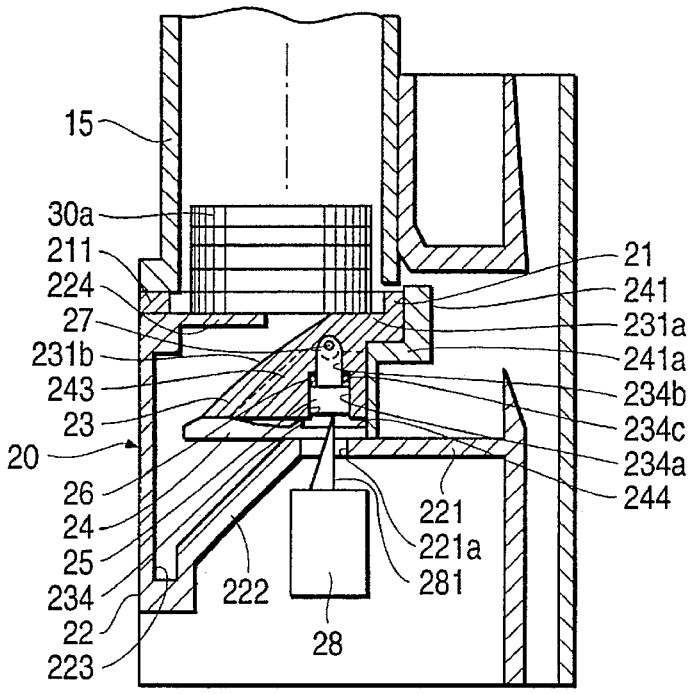
FIGS. 5 is an enlarged partial longitudinal sectional view of a relevant part of the coin mechanism in accordance with one embodiment of the present invention. In the drawing, a situation where the change returning device of FIG. 4 is on standby is illustrated.

As long as an operation of ejecting the coins 30*a* from the extra tube 15 is not required, the change returning device 20 is on standby so that the sliding plate member 24 is located at a forwardmost point of the reciprocating movement thereof as depicted in FIG. 5. As a result, the front end of the sliding plate member 24 and the lower edge 231*d* of the sloped surface 231*b* of the block member 23 forwardly project from the upper edge 222*a* of the sloped surface 222 of the coin catching plate member 22, and the lowest coin 30*a* stacked within the extra tube 15 is contained within the ring-shaped coin ejector 21 which is received by the flat portion 231*a* of the block member 23 and the receiving portion 224 of the coin catching plate member 22.

With reference to FIG. 5, when the returning device 20 is on standby, the solenoid 28 is maintained in a deenergized state so that the plunger 281 is maintained in a vertically projected out position. Therefore, the top end of the plunger 281 passes through the circular hole 221*a* of the coin catching plate member 22 and the cut-out portion 242 of the sliding plate member 24, and the top end of the plunger 281 lifts the pin element 25, together with the cylindrical rod 27 against the restoring force of the coil spring 26 by a certain distance.

When the pin element 25 is lifted by the certain distance, both ends of the cylindrical rod 27 are lifted away from the semicircular cutout portions 243*a* of the vertical walls 243. Therefore, no engagement between the cylindrical rod 27 and the semicircular cutout portions 243*a* is maintained, and hence, no engagement between the sliding plate member 24 and the block member 23 is maintained. Accordingly, even if the sliding plate member 24 is erroneously moved toward a rearmost point of the reciprocating movement thereof (to the right in FIG. 5), the lowest coin 30*a* stacked within the extra tube 15 is still contained within the ring-shaped coin ejector 21 which is received by the flat portion 231*a* of the block member 23 and the receiving portion 224 of the coin catching plate member 22. That is, an erroneous ejection of the coin 30*a* from the extra tube 15 is prevented in a situation when the returning device 20 is on standby.

Figure 6:
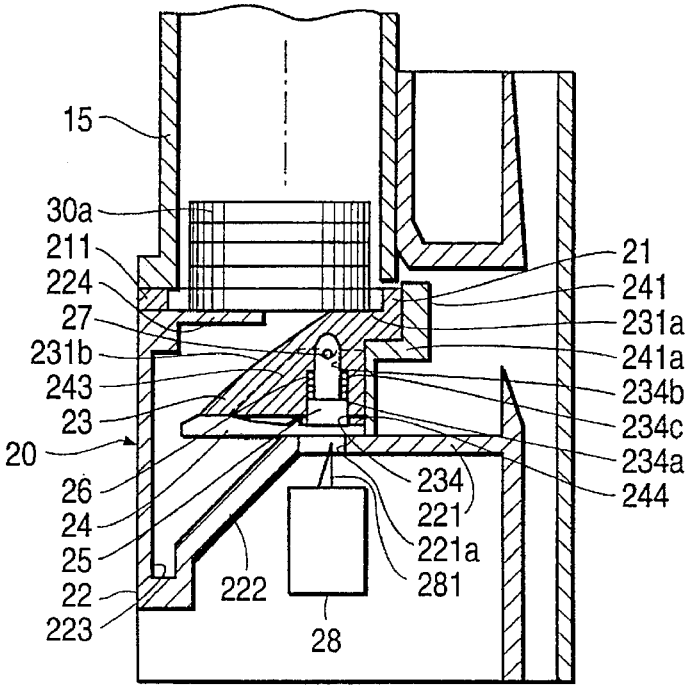
FIG. 6 is a view similar to FIG. 5. In the drawing, a situation where a coin ejector of the change returning device of FIG. 4 begins to move toward a rearmost point of the reciprocating movement thereof is illustrated.

With reference to FIG. 6, when the operation of ejecting the coins 30*a* from the extra tube 15 is required, the solenoid 28 is energized so that the plunger 281 is vertically pulled in. Therefore, the top end of the plunger 281 is positioned within the circular hole 221*a* of the coin catching plate member 22. As a result, the pin element 25 is moved downwardly, together with the cylindrical rod 27 by virtue of the restoring force of the coil spring 26, and the bottom end surface of the pin element 25 is then in contact with an upper surface of the flat indent 244 of the sliding plate member 24. When the bottom end surface of the pin element 25 is in contact with the upper surface of the flat indent 244, both ends of the cylindrical rod 27 are fitably received within the semicircular cutout portions 243*a* of the vertical walls 243. Therefore, as illustrated in FIG. 6, the cylindrical rod 27 and the semicircular cut-out portions 243*a* are firmly engaged, and hence, the sliding plate member 24 and the block member 23 are also firmly engaged.

Once the sliding plate member 24 and the block member 23 are firmly engaged, the sliding plate member 24 begins to be moved toward the rearmost point of the reciprocating movement thereof (to the right in FIG. 6), together with the block member 23 by virtue of operation of the driving device 29.

According to the rearward movement of the block member 23, the ring-shaped coin ejector 21 also moves, together with the coin 30*a* which is contained therewithin. Just after a time when an inner surface of a front peripheral region of the ring-shaped coin ejector 21 leaves from the receiving portion 224 of the coin catching plate member 22, the coin 30*a* falls from the ring-shaped coin ejector 21. The coin 30*a* falling from the coin ejector 21 is caught by the sloped surface 231*b* of the block member 23, and slides along the sloped surface 231*b* of the block member 23 and the sloped surface 222 of the coin catching plate member 22 with either the head or tail surface of the coin 30*a* in contact with an upper surface of the sloped surfaces 231*b* and 222, as illustrated in FIG. 7.

Figure 7:
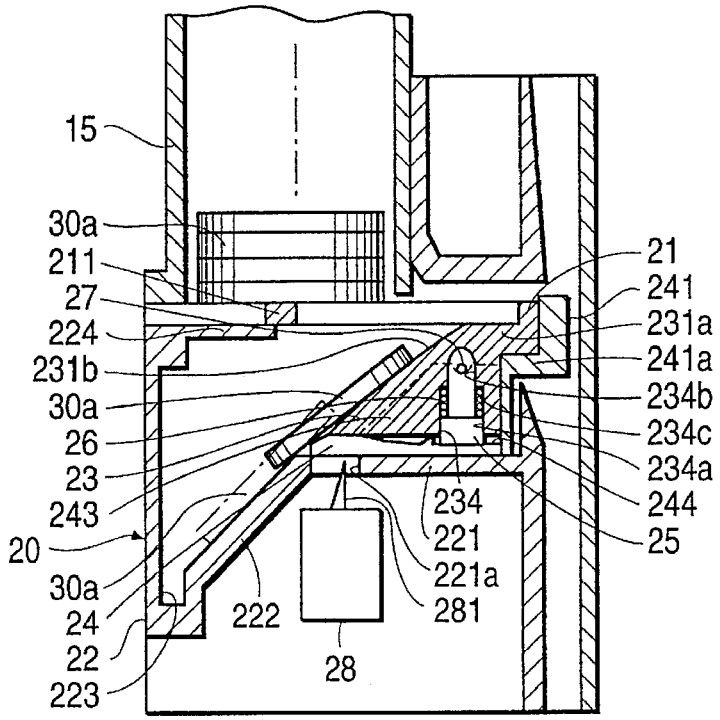
FIG. 7 is a view similar to FIG. 5. In the drawing, a situation where the coin ejector of the change returning device of FIG. 4 is positioned at the rearmost point of the reciprocating movement thereof is illustrated.

The rearward movement of the sliding plate member 24 is terminated when the sliding plate member 24 reaches the rearmost point of the reciprocating movement thereof, as depicted in FIG. 7. When the sliding plate member 24 reaches the rearmost point, the sloped surface 231*b* of the block member 23, the beveled portion 246 of the sliding plate member 24 and the sloped surface 231*b* of the coin catching plate member 22 are generally aligned with one another. Once the sliding plate member 24 reaches the rearmost point, the sliding plate member 24 begins to be moved forwardly (to the left in FIG. 7), together with the block member 23. Therefore, the front end of the sliding plate member 24 and the lower edge 231*d* of the sloped surface 231*b* of the block member 23 begin to forwardly project from the upper edge 222*a* of the sloped surface 222 of the coin catching plate member 22.

Figure 8:
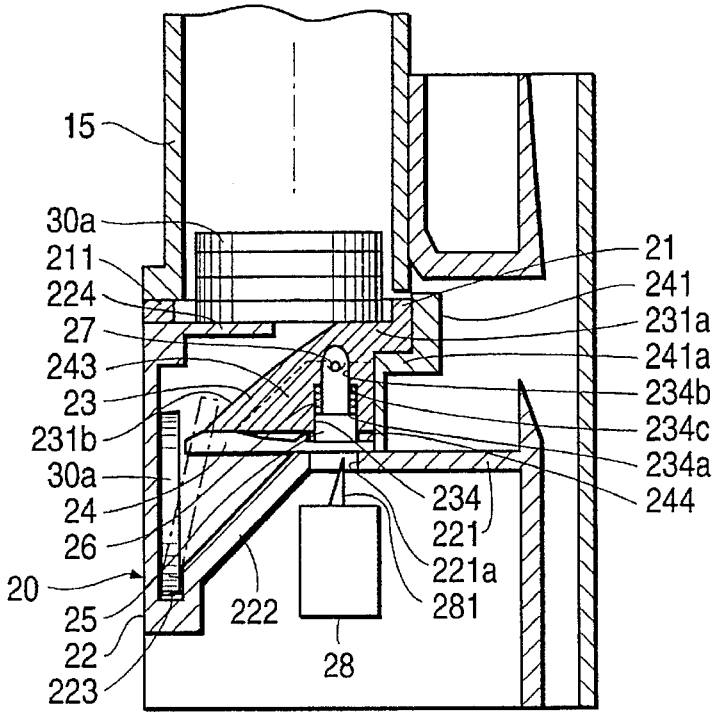
FIG. 8 is a view similar to FIG. 5. In the drawing, a situation where the coin ejector of the change returning device of FIG. 4 just reaches the forwardmost point of the reciprocating movement thereof is illustrated.

As a result, as illustrated in FIG. 8, during the forward movement of the block member 23 and the sliding plate member 24, the coin 30*a* sliding along the sloped surfaces 231*b* and 222 is effectively oriented in an upright position by the lower edge 231*d* of the sloped surface 231*b* of the block member 23 and the beveled portion 246 of the sliding plate member 24. Accordingly, the coin 30*a* sliding along the sloped surfaces 231*b* and 222 is more smoothly fitted into the vertical groove 223 of the coin catching plate member 22.

Once the coin 30*a* is fitted into the vertical groove 223, the coin 30*a* rolls along the inclined bottom surface 223*a* of the groove 223 as illustrated in FIG. 4. Finally, the coin 30*a* rolling along the inclined bottom surface 223*a* of the groove 223 leaves from a lower end of the groove 223, and falls to a change receiving window (not shown) through a funnel-shaped duct member (not shown).

According to the one embodiment of the present invention, since the coin 30*a* sliding along the sloped surfaces 231*b* and 222 is effectively oriented to be in an upright position by the lower edge 231*d* of the sloped surface 231*b* of the block member 23 and the beveled portion 246 of the sliding plate member 24 during the forward movement of the block member 23 and the sliding plate member 24, the coin 30*a* sliding along the sloped surfaces 231*b* and 222 is more smoothly fitted into the vertical groove 223. Therefore, it is not required to increase the degree of angular incline of the sloped surfaces 231*b* and 222 and, as a result, an unnecessary decrease in the longitudinal length of the extra tube 15 is avoided. Accordingly, the extra tube 15 can stack the sufficient numbers of coins 30*a* therewithin so that the vending machine is prevented from frequently running out of coins for the return of change and the vending machine can effectively operate.

Furthermore, though the coin mechanism according to this embodiment is provided with a single extra tube 15, the coin mechanism may be provided with a plurality of extra tubes 15, with which the change returning devices 20 are associated, respectively.

Moreover, the change returning devices 20 may be associated with the coin stacking tubes 14, if necessary.

This invention has been described in detail in connection with a preferred embodiment. The embodiment however, is merely for example only and the invention is not restricted thereto. It will be understood by those skilled in the art that other variations and modifications can be easily made within the scope of this invention as defined by the appended claims.

We claim:

1. A coin mechanism including at least one tube for layeredly stacking change coins therewithin and a change returning device, said change returning device comprising;

a ring-shaped member disposed at a position adjacent to a lower end of said at least one tube and capable of containing the lowest coin which is stacked within said at least one tube, a stationary member including a first sloped portion which comprises an upper edge and a lower edge, and a flat portion which extends from the upper edge of said first sloped portion, a sliding plate slidably disposed on said flat portion of said stationary member, a block member slidably disposed on said sliding plate, said block member including a second sloped portion which comprises an upper edge and a lower edge, and a flat portion which extends from the upper edge of said second sloped portion and is fixedly connected to a lower end surface of a first peripheral portion of said ring-shaped member, driving means operatively connected to said sliding plate so as to slidably reciprocate said sliding plate on said flat portion of said stationary member between a first furthermost point and a second furthermost point, said second furthermost being in a direction opposite to said first furthermost point, said sliding plate reciprocating in a direction generally perpendicular to both the lower edge of the second sloped portion and the upper edge of the first sloped portion, a receiving element receiving a second peripheral portion of said ring-shaped member opposite to said flat portion of said block member, engaging means for engaging said sliding plate with said block member in response to demand, and an inclined vertical groove extending from the lower edge of said first sloped portion, wherein the lower edge of the second sloped portion of said block member projects beyond the upper edge of the first sloped portion of said stationary member when said sliding plate reaches the first furthermost point together with said block member during a reciprocating motion of said sliding plate, and wherein the second sloped portion of said block member is generally aligned with the first sloped portion of said stationary member when said sliding plate reaches the second furthermost point together with said block member during the reciprocating motion of said sliding plate.

2. The coin mechanism of claim 1 wherein said at least one tube is cylindrical.

3. The coin mechanism of claim 1 wherein said sliding plate includes a beveled portion formed at one end thereof.

4. The coin mechanism of claim 3 wherein said beveled portion is generally aligned with the first sloped portion of said stationary member and the second sloped portion of said block member when said sliding plate reaches the second furthermost point together with said block member during the reciprocating motion of said sliding plate.

5. The coin mechanism of claim 1, further comprising a pair of vertical walls which are formed at an upper end surface of said sliding plate so as to sandwich said block member therebetween, a pin member slidably and resiliently disposed within a cavity which is formed at a lower end surface of said block member, and a cylindrical rod fixedly connected to a top end of said pin member, wherein both ends of said cylindrical rod project from opposite side surfaces of said block member, and are engaged with a pair of semicircular cut-out portions which are formed at a top end surface of said pair of vertical walls, respectively, in response to demand.

6. The coin mechanism of claim 5 wherein said engaging means includes said cylindrical rod and said semicircular cut-out portions.

7. The coin mechanism of claim 6 wherein said engaging means further includes a solenoid having a plunger which lifts said pin member so as to disengage the ends of said cylindrical rod from said semicircular cut-out portions when the solenoid is deenergized.

* * * * *